US011087660B2

(12) United States Patent
Wu

(10) Patent No.: US 11,087,660 B2
(45) Date of Patent: Aug. 10, 2021

(54) TIMING CONTROLLER AND OPERATING METHOD THEREOF

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 16 days.

(21) Appl. No.: 16/151,319

(22) Filed: Oct. 3, 2018

(65) Prior Publication Data

US 2020/0111397 A1 Apr. 9, 2020

(51) Int. Cl.

| | |
|---|---|
| ***G09G 3/20*** | (2006.01) |
| ***G09G 3/36*** | (2006.01) |
| ***G09G 3/3275*** | (2016.01) |

(52) U.S. Cl.

CPC ..... *G09G 3/20* (2013.01); *G09G 3/3275* (2013.01); *G09G 3/3685* (2013.01); *G09G 2310/027* (2013.01); *G09G 2310/08* (2013.01); *G09G 2320/0673* (2013.01)

(58) Field of Classification Search

CPC ..... G09G 3/20; G09G 3/32; G09G 3/36

See application file for complete search history.

(56) References Cited

U.S. PATENT DOCUMENTS

| | | | | |
|---|---|---|---|---|
| 2002/0047822 | A1* | 4/2002 | Senda | G09G 3/3659 345/90 |
| 2005/0231449 | A1* | 10/2005 | Miyagawa | G09G 3/2014 345/77 |
| 2006/0044224 | A1* | 3/2006 | Chae | G09G 3/293 345/63 |
| 2010/0315396 | A1* | 12/2010 | Weng | G09G 3/3688 345/208 |
| 2018/0061290 | A1 | 3/2018 | Kwon et al. | |

FOREIGN PATENT DOCUMENTS

| | | |
|---|---|---|
| TW | I282534 | 6/2007 |
| TW | 201102990 | 1/2011 |
| TW | I486936 | 6/2015 |

OTHER PUBLICATIONS

"Office Action of Taiwan Counterpart Application", dated Jul. 29, 2019, pp. 1-4.

* cited by examiner

*Primary Examiner* — Alexander Eisen
*Assistant Examiner* — Cory A Almeida
(74) *Attorney, Agent, or Firm* — JCIPRNET

(57) ABSTRACT

A timing controller and an operating method are provided. The timing controller includes a bit capture circuit and a gear position signal generation circuit. The bit capture circuit is configured to capture a first part bit from each of a plurality of original sub-pixel data of a video stream. The gear position signal generation circuit determines a gear position signal related to a current frame according to the first part bits. The gear position signal is provided to a gamma voltage generation circuit of a source driver such that the gamma voltage generation circuit changes a plurality of gamma voltages according to the gear position signal.

18 Claims, 6 Drawing Sheets

TIMING CONTROLLER AND OPERATING METHOD THEREOF

BACKGROUND OF THE INVENTION

1. Field of the Invention

The invention relates a display device, and more particularly, relates to a timing controller and an operating method thereof.

2. Description of Related Art

With advancements in electronic technology, consumer electronics products have become necessary tools in daily lives. In order to provide a good human-machine interface, it has also become a trend to arrange high-quality display devices on consumer electronic products. Therefore, how to effectively reduce the number of bits in sub-pixel data received by a digital-to-analog converter (DAC) of a source driver is a problem to be solved by those skilled in the art.

SUMMARY OF THE INVENTION

The invention provides a timing controller and an operating method thereof that can be used to effectively reduce the number of bits in the sub-pixel data received by the digital to analog converter of the source driver.

The timing controller of the invention includes a bit capture circuit and a gear position signal generation circuit. The bit capture circuit is configured to capture a first part bit from each of a plurality of original sub-pixel data of a video stream. The gear position signal generation circuit is coupled to the bit capture circuit to receive the first part bits, and determines a gear position signal related to a current frame according to the first part bits. The gear position signal is provided to a gamma voltage generation circuit of a source driver such that the gamma voltage generation circuit changes a plurality of gamma voltages according to the gear position signal.

The operating method of the invention includes: capturing a first part bit from each of a plurality of original sub-pixel data of a video stream through a bit capture circuit; determining a gear position signal related to a current frame according to the first part bits through a gear position signal generation circuit; and providing the gear position signal to a gamma voltage generation circuit of a source driver such that the gamma voltage generation circuit changes a plurality of gamma voltages according to the gear position signal.

Based on the above, the timing controllers described in the embodiments of the invention can capture the first part bits of the original sub-pixel data by utilizing the bit capture circuit and determine the gear position signal to be transmitted to the gamma voltage generation circuit according to the first part bits by utilizing the gear position signal generation circuit. The gamma voltage generation circuit can adjust a plurality of gamma voltages according to the gear position signal. According to the adjusted gamma voltages, the digital-to-analog converter transmits the source driving signals to a display panel.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
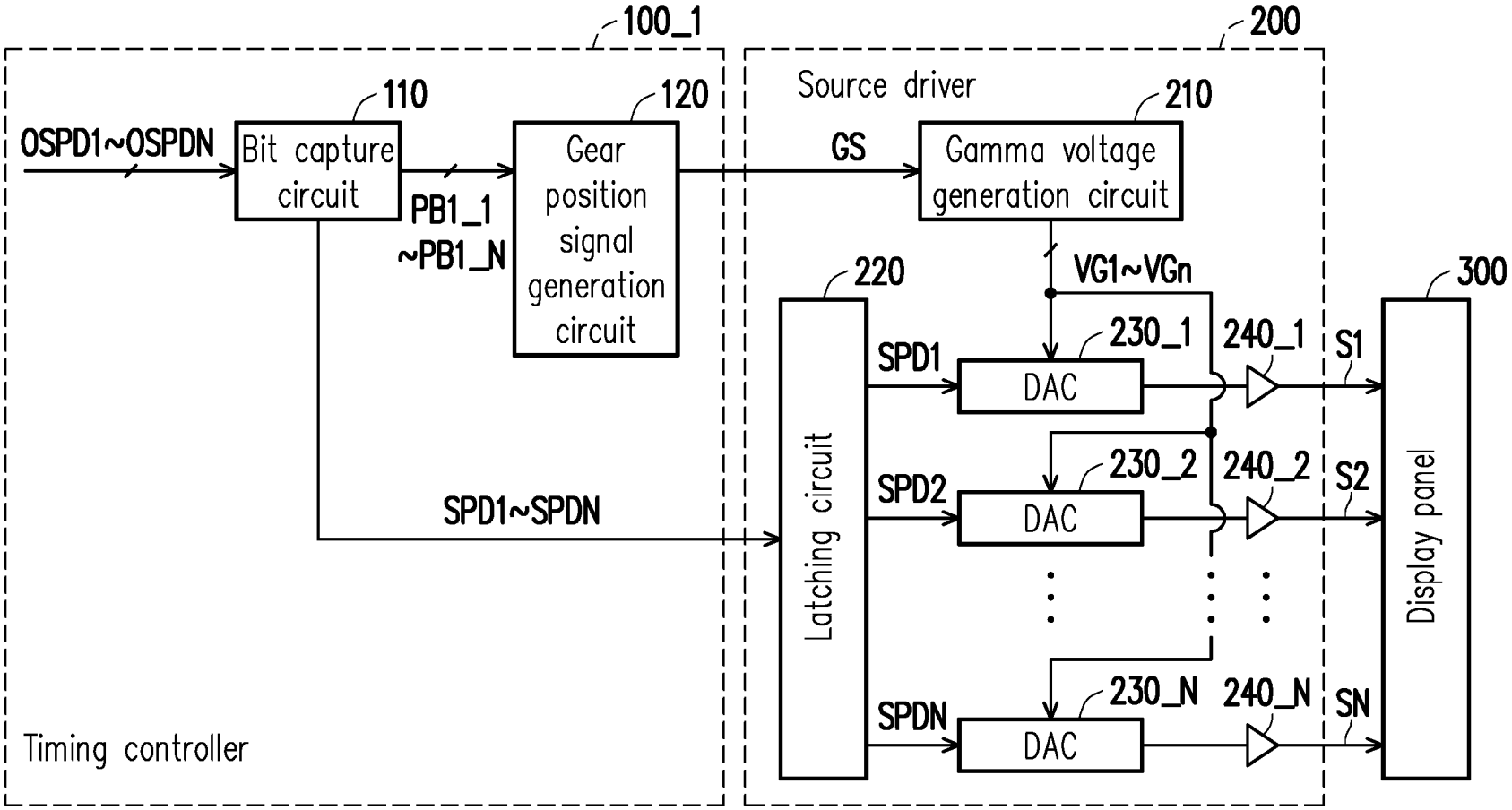
FIG. 1 is a circuit block diagram of a timing controller according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

The term "coupled (or connected)" used in this specification (including claims) may refer to any direct or indirect connection means. For example, "a first device is coupled (connected) to a second device" should be interpreted as "the first device is directly connected to the second device" or "the first device is indirectly connected to the second device through other devices or connection means". Moreover, elements/components/steps with same reference numerals represent same or similar parts in the drawings and embodiments. Elements/components/steps with the same reference numerals or names in different embodiments may be cross-referenced.

FIG. 1 is a circuit block diagram of a timing controller 100_1 according to an embodiment of the invention. With reference to FIG. 1, in this embodiment, the timing controller 100_1 includes a bit capture circuit 110 and a gear position signal generation circuit 120. The bit capture circuit 110 can capture corresponding first part bits PB1_1 to PB1N and processed sub-pixel data SPD1 to SPDN respectively from a plurality of original sub-pixel data OSPD1 to OSPDN of a video stream. In this embodiment, the processed sub-pixel data SPD1 to SPDN may be second part bits of the original sub-pixel data OSPD1 to OSPDN. The number of bits in the first part bits PB1_1 to PB1_N and the number of bits in the processed sub-pixel data SPD1 to SPDN may be determined based on design requirements. For instance, with the original sub-pixel data OSPD1 taken as an example, the first part bit PB1_1 may be two least significant bits (LSBs) in the original sub-pixel data OSPD1, and the processed sub-pixel data SPD1 may be eight most significant bits (MSBs) in the original sub-pixel data OSPD1. The rest of the original sub-pixel data may be deduced by analogy.

The gear position signal generation circuit 120 is coupled to the bit capture circuit 110 to receive the first part bits PB1_1 to PB1_N. The gear position signal generation circuit 120 determines a gear position signal GS related to a current frame according to the first part bits PB1_1 to PB1_N. The gear position signal generation circuit 120 can provide the gear position signal GS to a gamma voltage generation circuit 210 of a source driver 200.

On the other hand, the source driver 200 includes the gamma voltage generation circuit 210, a latching circuit 220, digital-to-analog converters (DACs) 230_1 to 230_N and output buffers 240_1 to 240_N. Herein, N is a positive integer. The gamma voltage generation circuit 210 is coupled to the gear position signal generation circuit 120 to receive the gear position signal GS. Here, the gamma voltage generation circuit 210 can provide and change a plurality of gamma voltages VG1 to VGn according to the gear position signal GS. The latching circuit 220 is coupled to the bit capture circuit 110 to receive the processed sub-pixel data SPD1 to SPDN. Here, the latching circuit 220 can latch the processed sub-pixel data SPD1 to SPDN and provide the processed sub-pixel data SPD1 to SPDN to the digital-to-analog converters 230_1 to 230_N respectively.

The digital-to-analog converters 230_1 to 230_N are coupled between the latching circuit 220 and the output buffers 240_1 to 240_N. The digital-to-analog converters 230_1 to 230_N are coupled to the gamma voltage generation circuit 210 to receive gamma voltages VG1 to VGn. The digital-to-analog converters 230_1 to 230_N receive the processed sub-pixel data SPD1 to SPDN form the latching circuit 220, respectively. According to the gamma voltage VG1 to VGn, each of the digital-to-analog converters 230_1 to 230_N can convert the corresponding one of the processed sub-pixel data SPD1 to SPDN into source driving signals S1 to SN, respectively. Further, the digital-to-analog converters 230_1 to 230_N can transmit the source driving signals S1 to SN to corresponding data lines (or also known as source lines) in a display panel 300 through the output buffers 240_1 to 240_N.

Figure 2:
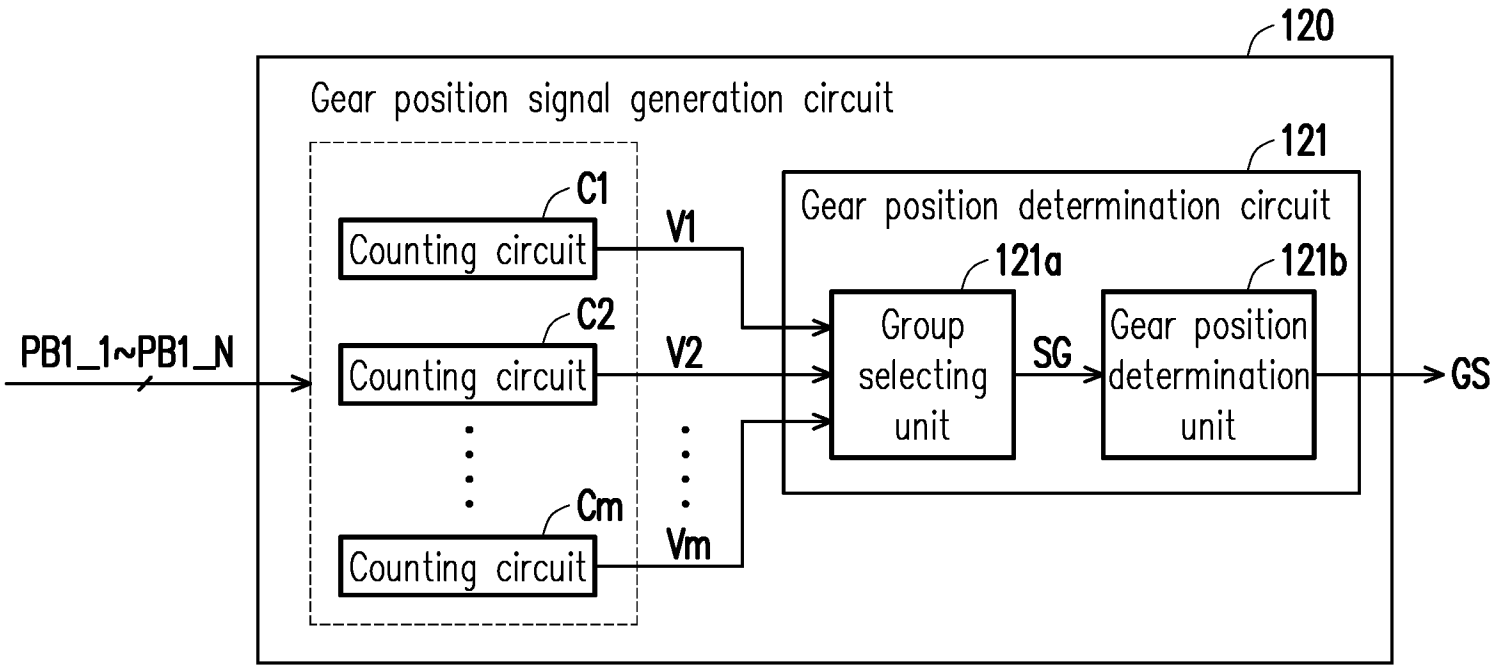
FIG. 2 is a circuit block diagram of the gear position signal generation circuit shown by FIG. 1 according to an embodiment of the invention.

FIG. 2 is a circuit block diagram of the gear position signal generation circuit 120 shown by FIG. 1 according to an embodiment of the invention. With reference to FIG. 1 and FIG. 2 together, in this embodiment, the gear position signal generation circuit 120 includes a plurality of counting circuits C1 to Cm and a gear position determination circuit 121. Here, the number m of the counting circuits C1 to Cm may be determined based on design requirements. The counting circuits C1 to Cm are coupled to the bit capture circuit 110 to receive the first part bits PB1_1 to PB1_N. It should be noted that, the counting circuits C1 to Cm may have counting conditions different from one another, and each of the counting circuits C1 to Cm may be configured to count a quantity of the first part bits PB1_1 to PB1_N that meet the corresponding counting condition so as to obtain count values V1 to Vm. The counting conditions may be determined based on design requirements.

For instance, in this embodiment, the counting condition of the counting circuit C1 may be "the content of the first part bit is 00". That is to say, the counting circuit C1 is configured to count/add up the quantity of all the first part bits (including the first part bits PB1_1 to PB1_N) having the bit value "00" in the same frame, and provide a counting result (the count value V1) to the gear position determination circuit 121. The counting condition of the counting circuit C2 may be "the content of the first part bit is 01". That is to say, the counting circuit C2 is configured to count/add up the quantity of all the first part bits (including the first part bits PB1_1 to PB1_N) having the bit value "01" in the same frame, and provide a counting result (the count value V2) to the gear position determination circuit 121. The counting condition of the counting circuit C3 may be "the content of the first part bit is 10". That is to say, the counting circuit C3 is configured to count/add up the quantity of all the first part bits (including the first part bits PB1_1 to PB1_N) having the bit value "10" in the same frame, and provide a counting result (the count value V3) to the gear position determination circuit 121. The counting condition of the counting circuit C4 may be "the content of the first part bit is 11". That is to say, the counting circuit C4 is configured to count/add up the quantity of all the first part bits (including the first part bits PB1_1 to PB1_N) having the bit value "11" in the same frame, and provide a counting result (the count value V4) to the gear position determination circuit 121.

Based on design requirements, in certain embodiments, the counting circuits C1 to Cm may include a plurality of group counting circuits (e.g., a group counting circuit C5 and a group counting circuit C6). In those embodiments, all the first part bits (including the first part bits PB1_1 to PB1_N) in the same frame may be divided into a plurality of groups (e.g., a first group GA and a second group GB), and the count values V1 to Vm may include a plurality of group count values (e.g., a first group count value V5 and a second group count value V6). Here, the first group count value V5 may be used to indicate a total of the first part bits in the first group GA, and the second group count value V6 may be used to indicate a total of the first part bits in the second group GB.

For instance, in this embodiment, the first part bits (including the first part bits PB1_1 to PB1_N) having first bit data (e.g., the bit value "00") or second bit data (e.g., the bit value "01") in the same frame are classified as the first group GA. In addition, the first part bits (including the first part bits PB1_1 to PB1_N) having third bit data (e.g., the bit value "10") or fourth bit data (e.g., the bit value "11") in the same frame are classified as the second group GB. Nonetheless, other embodiments of the invention are not limited in this regard. The counting condition of the group counting circuit C5 may be "the content of the first part bit is 00 or 01". That is to say, the group counting circuit C5 is configured to count/add up the total of first part bits having the bit values "00" or "01" among all the first part bits (including the first part bits PB1_1 to PB1N) in the same frame, and provide a counting result (the first group count value V5) to the gear position determination circuit 121. The counting condition of the group counting circuit C6 may be "the content of the first part bit is 10 or 11". That is to say, the group counting circuit C6 is configured to count/add up the total of first part bits having the bit values "10" or "11" among all the first part bits (including the first part bits PB1_1 to PB1_N) in the same frame, and provide a counting result (the second group count value V6) to the gear position determination circuit 121.

On the other hand, the gear position determination circuit 121 is coupled to the counting circuits C1 to Cm to receive the count values V1 to Vm. Here, the gear position determination circuit 121 can determine the gear position signal GS according to the count values V1 to Vm. In this embodiment, the gear position determination circuit 121 may include a group selecting unit 121*a* and a gear position determination unit 121*b*. Nonetheless, other embodiments of the invention are not limited in this regard. The group selecting unit 121*a* is coupled to the counting circuits C1 to Cm to receive the first group count value V5 and the second group count value V6. The group selecting unit 121*a* can determine a selected group according to the first group count value V5 and the second group count value V6 and provide a selecting result SG for indicating the selected group.

Further, the gear position determination unit 121*b* is coupled to the group selecting unit 121*a* to receive the selecting result SG. The gear position determination unit 121*b* can generate and determine the gear position signal GS according to the selected group (the selecting result SG) and the count values V1 to Vm.

For instance, when the group selecting unit 121*a* determines that a difference between the first group count value V5 and the second group count value V6 is greater than a first threshold VTH1, the group selecting unit 121*a* can select the first group GA to be the selected group and provide the selecting result SG related to the selected group to the gear position determination unit 121*b*. Relatively speaking, when the group selecting unit 121*a* determines that the difference between the first group count value V5 and the second group count value V6 is less than a second threshold VTH2, the group selecting unit 121*a* can select the second group GB to be the selected group and provide the selecting result SG related to the selected group to the gear position determination unit 121*b*. The first threshold VTH1 and the second threshold VTH2 may be determined based on design requirements. Here, in certain embodiments, the first threshold VTH1 is different from the second threshold VTH2. For example, the first threshold VTH1 may be greater than the second threshold VTH2. In some other embodiments, the first threshold VTH1 may be identical to the second threshold VTH2. It should be noted that, when the difference between the first group count value V5 and the second group count value V6 in the current frame is not greater than the first threshold VTH1 nor less than the second threshold VTH2, the group selecting unit 121*a* may continue to use the group selecting result from a previous frame to be the selected group of the current frame.

The gear position determination unit 121*b* determines the gear position signal GS according to the selected group indicated by the selecting result SG and the count values V1 to Vm. For instance, when the selecting result SG indicates that the selected group is the first group GA and a difference between the count value V1 related to the first bit data (e.g., the bit value "00") among the count values V1 to Vm and the count value V2 related to the second bit data (e.g., the bit value "01") among the count values V1 to Vm is greater than a third threshold VTH3, the gear position determination unit 121*b* can select a candidate gear position signal (e.g., the bit value "00") corresponding to the first bit data (e.g., the bit value "00") to be the gear position signal GS. Relatively speaking, when the selecting result SG indicates that the selected group is the first group GA and the difference between the count value V1 related to the first bit data (e.g., the bit value "00") among the count values V1 to Vm and the count value V2 related to the second bit data (e.g., the bit value "01") among the count values V1 to Vm is less than a fourth threshold VTH4, the gear position determination unit 121*b* can select a candidate gear position signal (e.g., the bit value "01") corresponding to the second bit data (e.g., the bit value "01") to be the gear position signal GS. The third threshold VTH3 and the fourth threshold VTH4 may be determined based on design requirements.

On the other hand, when the selecting result SG indicates that the selected group is the second group GB and a difference between the count value V3 related to the third bit data (e.g., the bit value "10") among the count values V1 to Vm and the count value V4 related to the fourth bit data (e.g., the bit value "11") among the count values V1 to Vm is greater than a fifth threshold VTH5, the gear position determination unit 121*b* can select a candidate gear position signal (e.g., the bit value "10") corresponding to the third bit data (e.g., the bit value "10") to be the gear position signal GS. Relatively speaking, when the selecting result SG indicates that the selected group is the second group GB and the difference between the count value V3 related to the third bit data (e.g., the bit value "10") among the count values V1 to Vm and the count value V4 related to the fourth bit data (e.g., the bit value "11") among the count values V1 to Vm is less than a sixth threshold VTH6, the gear position determination unit 121*b* can select a candidate gear position signal (e.g., the bit value "11") corresponding to the fourth bit data (e.g., the bit value "11") to be the gear position signal GS. The fifth threshold VTH5 and the sixth threshold VTH6 may be determined based on design requirements. Here, in certain embodiments, the third to the sixth threshold values VTH3 to VTH6 are different from one another. In some other embodiments, some (or all) of the third to the sixth threshold values VTH3 to VTH6 may be identical to one another. It should be noted that, when the result determined by the gear position determination unit 121*b* does not belong to any of the four cases described above, the gear position determination unit 121*b* may continue to use the gear position signal GS from the previous frame to be the gear position signal GS of the current frame.

The gamma voltage generation circuit 210 of the source driver 200 can correspondingly change the gamma voltages VG1 to VGn according to the gear position signal GS provided by the gear position signal generation circuit 120. The digital-to-analog converters 230_1 to 230_N can provide the source driving signals S1 to SN according to the gamma voltages VG1 to VGn and the processed sub-pixel data SPD1 to SPDN. The source driving signals S1 to SN are transmitted to the data lines (or known as the source lines) in the display panel 300 through the output buffers 240_1 to 240_N.

Figure 3:
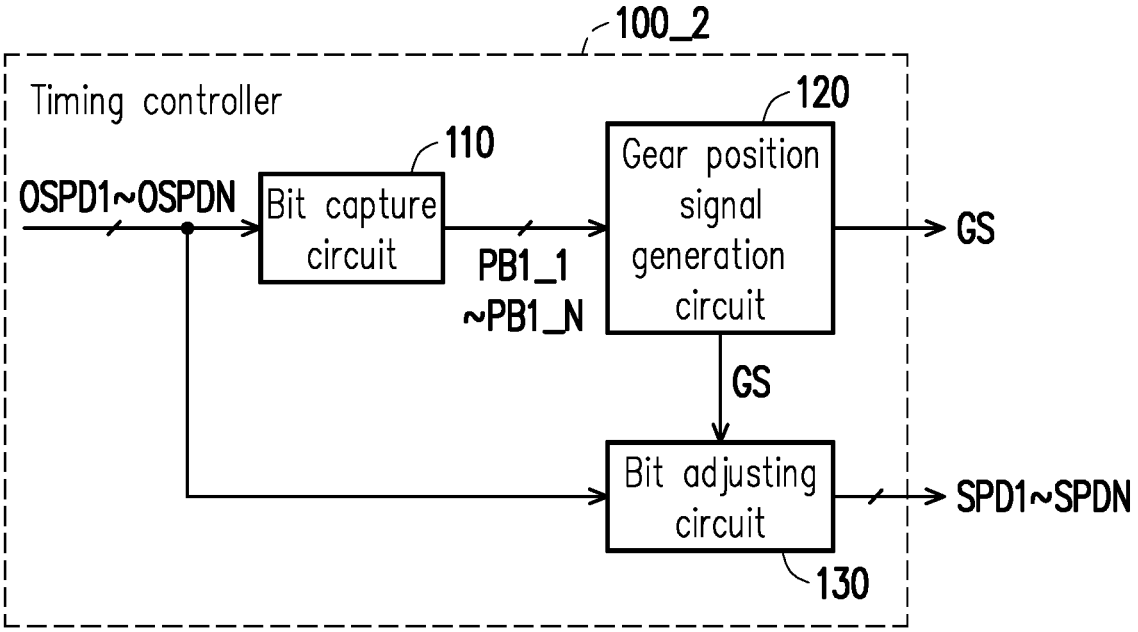
FIG. 3 is a circuit block diagram of a timing controller according to another embodiment of the invention.

FIG. 3 is a circuit block diagram of a timing controller 100_2 according to another embodiment of the invention. The timing controller 100_2 shown by FIG. 3 can supply the gear position signal GS and the processed sub-pixel data SPD1 to SPDN to a source driver (e.g., the source driver 200 shown by FIG. 1, which is not repeatedly described hereinafter). In the embodiment shown by FIG. 3, the timing controller 100_2 includes the bit capture circuit 110, the gear position signal generation circuit 120 and a bit adjusting circuit 130. The bit capture circuit 110 and the gear position signal generation circuit 120 shown by FIG. 3 may refer to related description for FIG. 1 and FIG. 2, which is not repeated hereinafter. In the embodiment shown by FIG. 3, the bit adjusting circuit 130 is coupled to the gear position signal generation circuit 120 to receive the gear position signal GS. The bit adjusting circuit 130 can receive second part bits PB2_1 to PB2_N of the original sub-pixel data OSPD1 to OSPDN. The number of bits in each of the second part bits PB2_1 to PB2_N may be determined based on design requirements. With the original sub-pixel data OSPD1 taken as an example, for instance, the second part bit PB2_1 may be eight most significant bits (MSBs) of the original sub-pixel data OSPD1. The rest of the original sub-pixel data may be deduced by analogy.

In this embodiment, the bit adjusting circuit 130 can determine whether to adjust the second part bit of each of the original sub-pixel data OSPD1 to OSPDN according to the gear position signal GS so as to obtain the processed sub-pixel data SPD1 to SPDN. Further, the bit adjusting circuit 130 can provide the processed sub-pixel data SPD1 to SPDN to the latching circuit 220 of the source driver 200.

Operational details for the bit adjusting circuit 130 are described as follows. When the bit value of the gear position signal GS selected by the gear position signal generation circuit 120 is identical to the bit value of the first part bit of current sub-pixel data (e.g., the two LSBs of the current sub-pixel data) among the original sub-pixel data OSBD1 to OSBDN, the bit adjusting circuit 130 may not adjust the second part bit of the current sub-pixel data (e.g., the eight MSBs of the current sub-pixel data). Relatively speaking, when the bit value of the gear position signal GS selected by the gear position signal generation circuit 120 is different from the bit value of the first part bit of the current sub-pixel data among the original sub-pixel data OSBD1 to OSBDN, the bit adjusting circuit 130 may adjust (increase or decrease) or not adjust the second part bit of the current sub-pixel data.

For instance, it is assumed herein that the gear position signal generation circuit 120 selects a first candidate gear position signal (e.g., the bit value "00") corresponding to the first data bit or a second candidate gear position signal (e.g., the bit value "01") corresponding to the second data bit to be the gear position signal GS. When the assumption above is met and the first part bit of the current sub-pixel data among the original sub-pixel data OSBD1 to OSBDN is the first bit data (e.g., the bit value "00"), the second bit value (e.g., the bit value "01"), the third bit data (e.g., the bit value "10") or the fourth bit data (e.g., the bit value "11"), the bit adjusting circuit 130 may not adjust the second part bit of the current sub-pixel data. That is, the second part bit of the current sub-pixel data is used as the processed sub-pixel data corresponding to the current sub-pixel data (e.g., one of the processed sub-pixel data SPD1 to SPDN).

Relatively speaking, it is assumed herein that the gear position signal generation circuit 120 selects a third candidate gear position signal (e.g., the bit value "10") corresponding to the third data bit or a fourth candidate gear position signal (e.g., the bit value "11") corresponding to the fourth data bit to be the gear position signal GS. When the assumption above is met and the first part bit of the current sub-pixel data among the original sub-pixel data OSBD1 to OSBDN is the first bit data (e.g., the bit value "00") or the second bit value (e.g., the bit value "01"), the bit adjusting circuit 130 may decrease the second part bit of the current sub-pixel data (e.g., by subtracting 1 from the bit value of the second part bit), so as to obtain the processed sub-pixel data corresponding to the current sub-pixel data. When the assumption above is met and the first part bit of the current sub-pixel data among the original sub-pixel data OSBD1 to OSBDN is the third bit data (e.g., the bit value "10") or the fourth bit data (e.g., the bit value "11"), the bit adjusting circuit 130 may not adjust the second part bit of the current sub-pixel data. That is, the second part bit of the current sub-pixel data is used as the processed sub-pixel data corresponding to the current sub-pixel data.

Operational details for the bit adjusting circuit 130 may not be limited by the above. In another embodiment, when the gear position signal GS is "00" or "01" and the first part bit of the current sub-pixel data among the original sub-pixel data OSBD1 to OSBDN is the third bit data (e.g., the bit value "10") or the fourth bit data (e.g., the bit value "11"), the bit adjusting circuit 130 may increase the second part bit of the current sub-pixel data (e.g., by adding 1 to the bit value of the second part bit) to be the processed sub-pixel data corresponding to the current sub-pixel data. In other cases, the bit adjusting circuit 130 may not adjust the second part bit of the current sub-pixel data, That is, the second part bit of the current sub-pixel data is used as the processed sub-pixel data corresponding to the current sub-pixel data.

In yet another embodiment, when the gear position signal GS is "00" or "01" and the first part bit of the current sub-pixel data is the third bit data (e.g., the bit value "10") or the fourth bit data (e.g., the bit value "11"), the bit adjusting circuit 130 may increase the second part bit of the current sub-pixel data (e.g., by adding 1 to the bit value of the second part bit) to be the processed sub-pixel data corresponding to the current sub-pixel data. When the gear position signal GS is "10" or "11" and the first part bit of the current sub-pixel data is the first bit data (e.g., the bit value "00") or the second bit data (e.g., the bit value "01"), the bit adjusting circuit 130 may decrease the second part bit of the current sub-pixel data (e.g., by subtracting 1 from the bit value of the second part bit), so as to obtain the processed sub-pixel data corresponding to the current sub-pixel data. In other cases, the bit adjusting circuit 130 may not adjust the second part bit of the current sub-pixel data, That is, the second part bit of the current sub-pixel data is used as the processed sub-pixel data corresponding to the current sub-pixel data.

Figure 4:
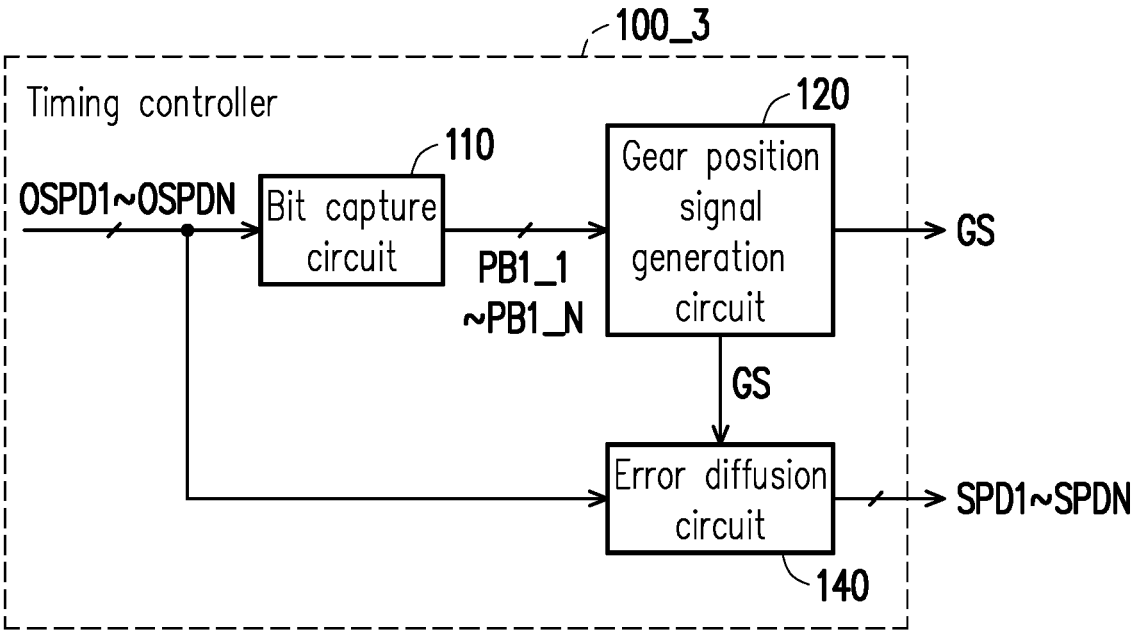
FIG. 4 is a circuit block diagram of a timing controller according to yet another embodiment of the invention.

FIG. 4 is a circuit block diagram of a timing controller 100_3 according to yet another embodiment of the invention. The timing controller 100_3 shown by FIG. 4 can supply the gear position signal GS and the processed sub-pixel data SPD1 to SPDN to a source driver (e.g., the source driver 200 shown by FIG. 1, which is not repeatedly described hereinafter). In the embodiment shown by FIG. 4, the timing controller 100_3 includes the bit capture circuit 110, the gear position signal generation circuit 120 and an error diffusion circuit 140. The bit capture circuit 110 and the gear position signal generation circuit 120 shown by FIG. 4 may refer to related description for FIG. 1 and FIG. 2, which is not repeated hereinafter. In the embodiment shown by FIG. 4, the error diffusion circuit 140 is coupled to the gear position signal generation circuit 120 to receive the gear position signal GS. The error diffusion circuit 140 further receives the original sub-pixel data OSPD1 to OSPDN. The error diffusion circuit 140 can adjust the original sub-pixel data of a current sub-pixel according to an error value related to at least one neighboring sub-pixel so as to obtain processed sub-pixel data of the current sub-pixel.

Figure 5:
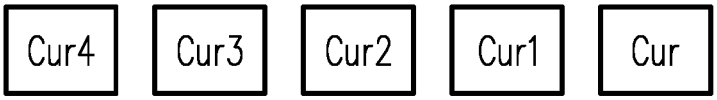
FIG. 5 is a schematic diagram illustrating a current sub-pixel and neighboring sub-pixels according to an embodiment of the invention.

Specifically, FIG. 5 is a schematic diagram illustrating a current sub-pixel and neighboring sub-pixels according to an embodiment of the invention. The embodiment shown by FIG. 5 illustrates a current sub-pixel Cur, a neighboring sub-pixel Cur1, a neighboring sub-pixel Cur2, a neighboring sub-pixel Cur3 and a neighboring sub-pixel Cur4. The current sub-pixel Cur and the neighboring sub-pixels Cur1 to Cur4 may have the same color (e.g., red, green or blue).

With reference to FIG. 4 and FIG. 5, the error diffusion circuit 140 can calculate a gray level error of each of the neighboring sub-pixels Cur1 to Cur4. The gray level error value may be a difference between the original sub-pixel data of the neighboring sub-pixel and new sub-pixel data of the neighboring sub-pixel. Here, the new sub-pixel data may be composed of the second part bit (e.g., eight MSBs of the original sub-pixel data) of the original sub-pixel data of the neighboring sub-pixel and the gear position signal GS. For instance, if the gear position signal GS of the current frame is "00" and the original sub-pixel data of the neighboring sub-pixel Cur4 is "1111 0101 11", the new sub-pixel data of the neighboring sub-pixel Cur4 would be "1111 0101 00" (i.e., a composition of "1111 0101" and "00"). Accordingly, the gray level error of the neighboring sub-pixel Cur4 is a difference obtained by subtracting "1111 0101 00" from "1111 0101 11". Calculation for the gray level errors of the other neighboring sub-pixels Cur1 to Cur3 may refer to the above description for the neighboring sub-pixel Cur4.

In the embodiment shown by FIG. 4, the error diffusion circuit 140 can adjust the current sub-pixel Cur according to the error value related to the neighboring sub-pixel of the current sub-pixel Cur so as to obtain the processed sub-pixel data of the current sub-pixel Cur. Next, the error diffusion circuit 140 can transmit the processed sub-pixel data SPD1 to SPDN to the source driver 200. In certain embodiments, said error value may be a weighted sum of the gray level errors of the neighboring sub-pixels Cur1 to Cur4. It is worth noting that, among the neighboring sub-pixels Cur1 to Cur4, the neighboring sub-pixel closer to the current sub-pixel cur has a greater weight, and the neighboring sub-pixel farther from the current sub-pixel Cur has a smaller weight. However, the other embodiments of the invention are not limited in this regard.

For instance, it is assumed that the second part bit of the original sub-pixel data (e.g., eight MSBs of the original sub-pixel data) of the current sub-pixel Cur is D0; the gray level error and a weight of the neighboring sub-pixel Cur1 are D1 and W1; the gray level error and a weight of the neighboring sub-pixel Cur2 are D2 and W2; the gray level error and a weight of the neighboring sub-pixel Cur3 are D3 and W3; and the gray level error and a weight of the neighboring sub-pixel Cur4 are D4 and W4. Accordingly, processed sub-pixel data SPD of the current sub-pixel Cur is D0+D1*W1+D2*W2+D3*W3+D4*W4. Here, "D1*W1+D2*W2+D3*W3+D4*W4" may be regarded as the error value related to said at least one neighboring sub-pixel. The weights W1 to W4 may be determined based on design requirements. For example (but not limited thereto), the weight W1 may be 7/16; the weight W2 may be 5/16, the weight W3 may be 3/16; and the weight W4 may be 1/16.

Figure 6:
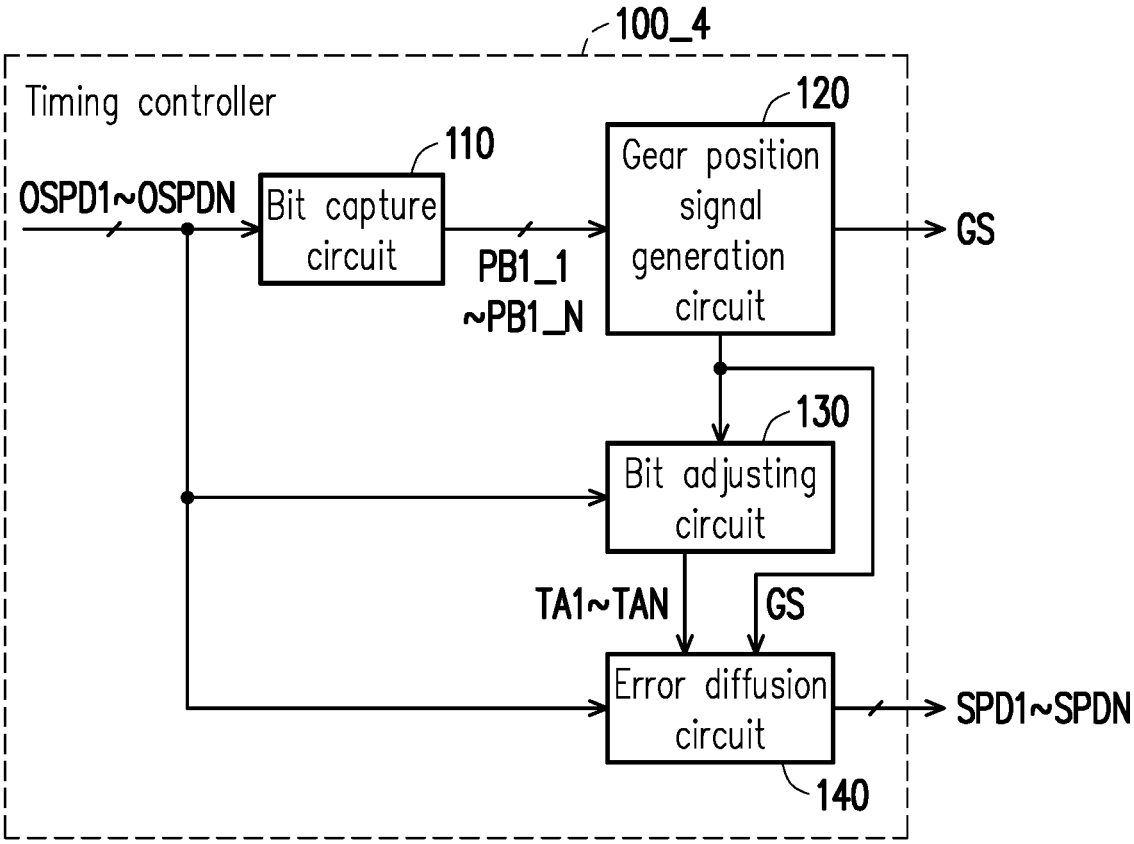
FIG. 6 is a circuit block diagram of a timing controller according to still another embodiment of the invention.

FIG. 6 is a circuit block diagram of a timing controller 100_4 according to still another embodiment of the invention. The timing controller 100_4 shown by FIG. 6 can supply the gear position signal GS and the processed sub-pixel data SPD1 to SPDN to a source driver (e.g., the source driver 200 shown by FIG. 1, which is not repeatedly described hereinafter). In the embodiment shown by FIG. 6, the timing controller 100_4 includes the bit capture circuit 110, the gear position signal generation circuit 120, the bit adjusting circuit 130 and the error diffusion circuit 140. The bit capture circuit 110 and the gear position signal generation circuit 120 shown by FIG. 6 may refer to related description for FIG. 1 and FIG. 2, which is not repeated hereinafter.

The bit adjusting circuit 130 shown by FIG. 6 may refer to related description for FIG. 3, which is not repeated hereinafter. In the embodiment shown by FIG. 6, "the processed sub-pixel data SPD1 to SPDN" originally output by the bit adjusting circuit 130 shown by FIG. 3 are used as "temporary data TA1 to TAN" shown by FIG. 6. The bit adjusting circuit 130 shown by FIG. 6 can determine whether to adjust the second part bits PB2_1 to PB2_N of the original sub-pixel data OSPD1 to OSPDN according to the gear position signal GS so as to obtain the temporary data TA1 to TAN.

The error diffusion circuit 140 shown by FIG. 6 may refer to the related descriptions for FIG. 4 and FIG. 5. The error diffusion circuit 140 shown by FIG. 6 is coupled to the bit adjusting circuit 130 to receive the temporary data TA1 to TAN. In addition, the bit adjusting circuit 140 shown by FIG. 6 further receives the original sub-pixel data OSPD1 to OSPDN.

The error diffusion circuit 140 shown by FIG. 6 can adjust the temporary data of a current sub-pixel (e.g., the current sub-pixel Cur shown by FIG. 5) according to the error values related to the neighboring sub-pixels (e.g., the neighboring sub-pixels Cur1 to Cur4 shown by FIG. 5) of the current sub-pixel so as to obtain the processed sub-pixel data. For instance, it is assumed that the temporary data of the current sub-pixel Cur is TA; the gray level error and the weight of the neighboring sub-pixel Cur1 are D1 and W1; the gray level error and the weight of the neighboring sub-pixel Cur2 are D2 and W2; the gray level error and the weight of the neighboring sub-pixel Cur3 are D3 and W3; and the gray level error and the weight of the neighboring sub-pixel Cur4 are D4 and W4. Accordingly, the processed sub-pixel data SPD of the current sub-pixel Cur is TA+D1*W1+D2*W2+D3*W3+D4*W4. The error diffusion circuit 140 shown by FIG. 6 may refer to the related descriptions for FIG. 4 and FIG. 5, which is not repeated hereinafter.

Figure 7:
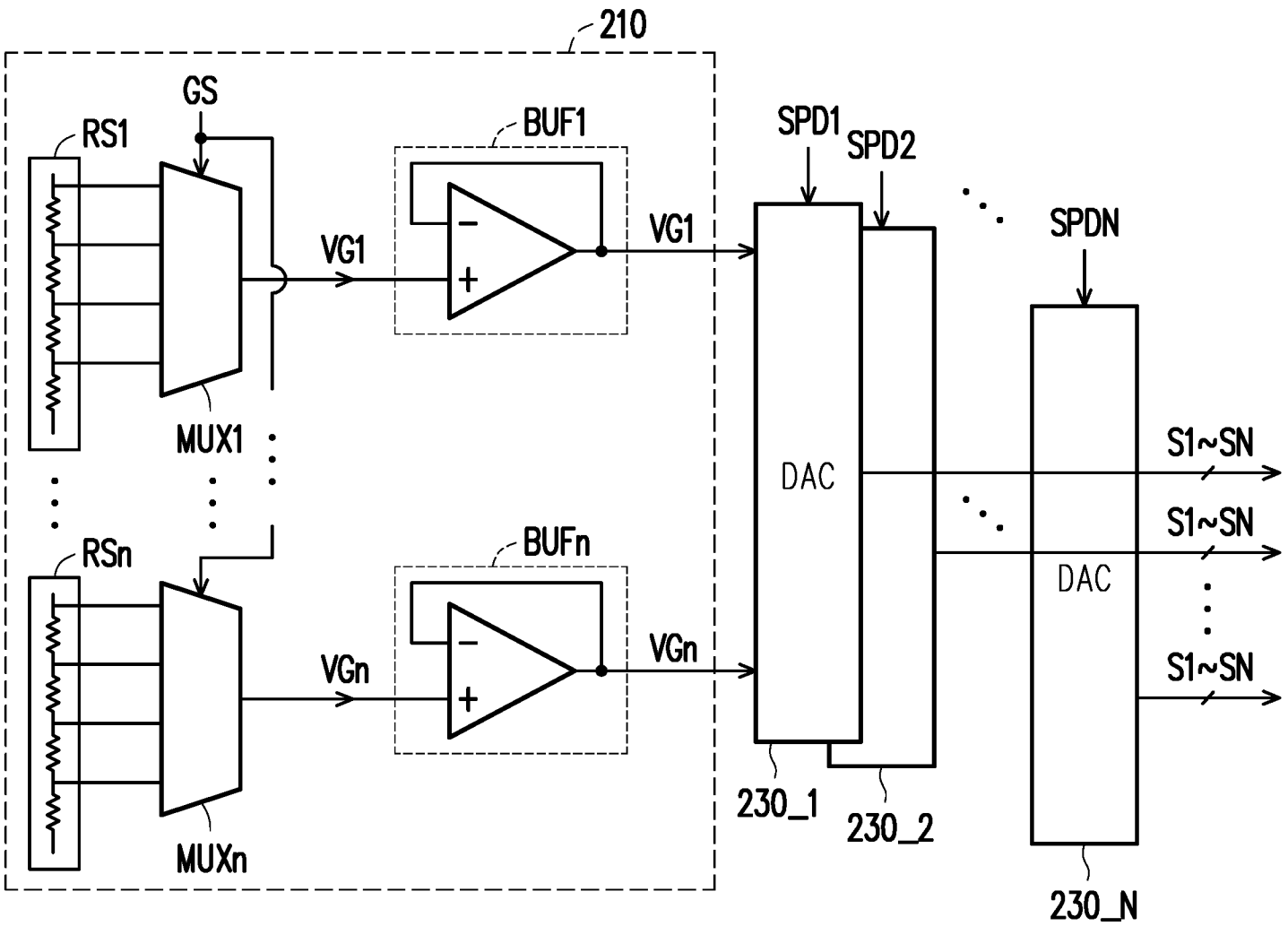
FIG. 7 is a circuit block diagram of the gamma voltage generation circuit shown by FIG. 1 according to an embodiment of the invention.

FIG. 7 is a circuit block diagram of the gamma voltage generation circuit 210 shown by FIG. 1 according to an embodiment of the invention. With reference to FIG. 1 and FIG. 7, the gamma voltage generation circuit 210 includes resistor strings RS1 to RSn, multiplexers MUX1 to MUXn and buffers BUF1 to BUFn. Among them, each of the resistor strings RS1 to RSn may be composed of a plurality of resistors connected in series to each other. These resistor strings RS1 to RSn are connected in series to each other to provide voltage-dividing voltages. In this embodiment, the multiplexers MUX1 to MUXn are coupled to the gear position signal generation circuit 120 to receive the gear position signal GS. A plurality of input terminals of each of the multiplexers MUX1 to MUXn are respectively coupled to different voltage-dividing nodes of one corresponding resistor string among the resistor strings RS1 to RSn, as shown by FIG. 7. According to the gear position signal GS, each of the multiplexers MUX1 to MUXn can select one corresponding voltage-dividing voltage among the voltage-dividing voltages from the corresponding resistor strings to be one corresponding gamma voltage among the gamma voltages VG1 to VGn. Output terminals of the multiplexer MUX1 to MUXn can provide the gamma voltages VG1 to VGn to input terminals of the buffers BUF1 to BUFn.

On the other hand, the buffers BUF1 to BUFn are respectively coupled to the output terminals of the multiplexers MUX1 to MUXn to receive the corresponding gamma voltages VG1 to VGn. Output terminals of the buffers BUF1 to BUFn are coupled to reference voltage input terminals of the digital-to-analog converters 230_1 to 230_N to provide the gamma voltages VG1 to VGn. In addition, each of the digital-to-analog converters 230_1 to 230_N can correspondingly generate the source driving signals S1 to SN respectively according to the processed sub-pixel data SPD1 to SPDN provided by the latching circuit 220 and the gamma voltages VG1 to VGn.

Figure 8:
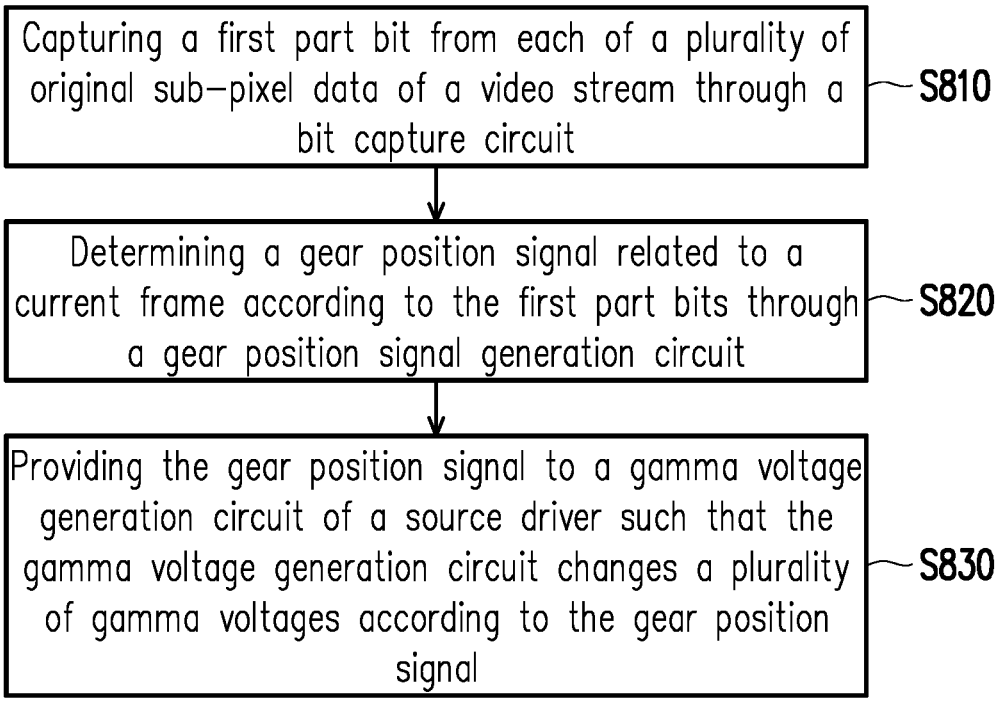
FIG. 8 is a flowchart of an operating method of a timing controller according to an embodiment of the invention.

FIG. 8 is a flowchart of an operating method of a timing controller according to an embodiment of the invention. Referring to FIG. 1 and FIG. 8 together, in step S810, the timing controller 100_1 can capture the first part bits PB1_1 to PB1_N from each of the original sub-pixel data OSPD1 to OSPDN of the video stream through the bit capture circuit 110. In step S820, the timing controller 100_1 can determine the gear position signal GS related to the current frame according to the first part bits PB1_1 to PB1_N through the gear position signal generation circuit 120. In step S830, the timing controller 100_1 can provide the gear position signal GS to the gamma voltage generation circuit 210 of the source driver 200 through the gear position signal generation circuit 120 such that the gamma voltage generation circuit 210 changes the gamma voltages VG1 to VGn according to the gear position signal GS. Relevant implementation details regarding the steps above have been described in foregoing embodiments and implementations, which are not repeated hereinafter.

In summary, the timing controllers described in the embodiments of the invention can capture the first part bits of the original sub-pixel data by utilizing the bit capture circuit 110 and determine the gear position signal GS to be transmitted to the gamma voltage generation circuit 210 according to the first part bits by utilizing the gear position signal generation circuit 120. The gamma voltage generation circuit can adjust the gamma voltages VG1 to VGn according to the gear position signal GS. The digital-to-analog converters can convert the processed sub-pixel data into the source driving signals according to the adjusted gamma voltages VG1 to VGn and transmit the source driving signals to the display panel. In this way, the number of bits in the received sub-pixel data may be effectively reduced, thereby improving the quality of the display picture.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A timing controller, comprising:

a bit capture circuit, configured to capture a first part bit from each of a plurality of original sub-pixel data of a video stream, wherein the first part bit is two least significant bits in each of the plurality of original sub-pixel data; and a gear position signal generation circuit, coupled to the bit capture circuit to receive the first part bits, and determining a gear position signal related to a current frame according to the first part bits, wherein the gear position signal is provided to a gamma voltage generation circuit of a source driver such that the gamma voltage generation circuit changes a plurality of gamma voltages according to the gear position signal, wherein the gear position signal generation circuit comprises:

a plurality of counting circuits, coupled to the bit capture circuit, wherein the counting circuits have counting conditions different from one another, and the counting condition is related to a bit value of each of the first part bits, and each of the counting circuits is configured to obtain a count value by counting a quantity of the first part bits that meet the corresponding counting condition; and a gear position determination circuit, coupled to the counting circuits to receive the count values, and configured to determine the gear position signal according to the count values.

2. The timing controller according to claim 1, wherein the first part bits are divided into a plurality of groups, and the count values comprise a plurality of group count values, wherein each of the group count values is a total of the first part bits in one corresponding group among the groups, and the gear position determination circuit comprises:

a group selecting unit, coupled to the counting circuits to receive the group count values, and configured to determine a selected group according to the group count values; and a gear position determination unit, coupled to the group selecting unit, and configured to determine the gear position signal according to the selected group and the count values.

3. The timing controller according to claim 2, wherein the groups comprise a first group and a second group, and the group count values comprise a first group count value and a second group count value, wherein the group selecting unit selects the first group to be the selected group when a difference between the first group count value and the second group count value is greater than a first threshold, wherein the group selecting unit selects the second group to be the selected group when the difference between the first group count value and the second group count value is less than a second threshold.

4. The timing controller according to claim 3, wherein the first part bits belonging to the first group comprise first bit data and second bit data, and the first part bits belonging to the second group comprise third bit data and fourth bit data, wherein when the selected group is the first group and a difference between a count value related to the first bit data among the count values and a count value related to the second bit data among the count values is greater than a third threshold, the gear position determination unit selects a candidate gear position signal corresponding to the first bit data to be the gear position signal, wherein when the selected group is the first group and the difference between the count value related to the first bit data among the count values and the count value related to the second bit data among the count values is less than a fourth threshold, the gear position determination unit selects a candidate gear position signal corresponding to the second bit data to be the gear position signal, wherein when the selected group is the second group and a difference between a count value related to the third bit data among the count values and a count value related to the fourth bit data among the count values is greater than a fifth threshold, the gear position determination unit selects a candidate gear position signal corresponding to the third bit data to be the gear position signal, and wherein when the selected group is the second group and the difference between the count value related to the third bit data among the count values and the count value related to the fourth bit data among the count values is less than a sixth threshold, the gear position determination unit selects a candidate gear position signal corresponding to the fourth bit data to be the gear position signal.

5. The timing controller according to claim 1, further comprising a bit adjusting circuit, coupled to the gear position signal generation circuit to receive the gear position signal, and configured to determine whether to adjust a second part bit of each of the original sub-pixel data for obtaining a plurality of processed sub-pixel data according to the gear position signal, wherein the processed sub-pixel data are provided to the source driver.

6. The timing controller according to claim 5, wherein the first part bits comprise first bit data, second bit data, third bit data and fourth bit data, wherein when the gear position signal generation circuit selects a first candidate gear position signal corresponding to the first bit data to be the gear position signal and the first part bit of current sub-pixel data among the original sub-pixel data is the first bit data, the bit adjusting circuit uses a second part bit of the current sub-pixel data as the processed sub-pixel data corresponding to the current sub-pixel data; and when the gear position signal generation circuit selects the first candidate gear position signal corresponding to the first bit data to be the gear position signal and the first part bit of the current sub-pixel data among the original sub-pixel data is the third bit data, the bit adjusting circuit increases or decreases the second part bit of the current sub-pixel data so as to obtain the processed sub-pixel data corresponding to the current sub-pixel data.

7. The timing controller according to claim 1, further comprising an error diffusion circuit, coupled to the gear position signal generation circuit to receive the gear position signal, and configured to adjust the original sub-pixel data of a current sub-pixel according to an error value related to at least one neighboring sub-pixel data of the current sub-pixel so as to obtain processed sub-pixel data of the current sub-pixel data, wherein the processed sub-pixel data is provided to the source driver.

8. The timing controller according to claim 7, wherein the at least one neighboring sub-pixel data comprises a plurality of neighboring sub-pixels, each of the neighboring sub-pixels having a gray level error, the gray level error value being a difference between the original sub-pixel data of the neighboring sub-pixel and new sub-pixel data of the neighboring sub-pixel, the new sub-pixel data being composed of second part bit of the original sub-pixel data of the neighboring sub-pixel and the gear position signal, the error value being a weighted sum of the gray level errors.

9. The timing controller according to claim 1, further comprising a bit adjusting circuit, coupled to the gear position signal generation circuit to receive the gear position signal, and configured to determine whether to adjust a second part bit of each of the original sub-pixel data for obtaining a plurality of temporary data according to the gear position signal; and an error diffusion circuit, coupled to the gear position signal generation circuit to receive the gear position signal, and coupled to the bit adjusting circuit to receive the temporary data, wherein the error diffusion circuit is configured to adjust the temporary data of a current sub-pixel according to an error value related to at least one neighboring sub-pixel of the current sub-pixel so as to obtain processed sub-pixel data of the current sub-pixel, wherein the processed sub-pixel data is provided to the source driver.

10. An operating method of a timing controller, comprising:

capturing a first part bit from each of a plurality of original sub-pixel data of a video stream through a bit capture circuit, wherein the first part bit is two least significant bits in each of the plurality of original sub-pixel data;

determining a gear position signal related to a current frame according to the first part bits through a gear position signal generation circuit; and providing the gear position signal to a gamma voltage generation circuit of a source driver such that the gamma voltage generation circuit changes a plurality of gamma voltages according to the gear position signal, wherein the step of determining the gear position signal related to the current frame comprises:

receiving the first part bits through a plurality of the counting circuits, wherein the counting circuits have counting conditions different from one another, and the counting condition is related to a bit value of each of the first part bits, and a count value is obtained through each of the counting circuits by counting a quantity of the first part bits that meet the corresponding counting condition; and determining the gear position signal according to the count values through a gear position determination circuit.

11. The operating method according to claim 10, wherein the step of determining the gear position signal according to the count values comprises:

dividing the first part bits into a plurality of groups, wherein the count values comprise a plurality of group count values, and each of the group count values is a total of the first part bits in one corresponding group among the groups;

determining a selected group according to the group count values through a group selecting unit; and determining the gear position signal according to the selected group and the count values through a gear position determination unit.

12. The operating method according to claim 11, wherein the groups comprise a first group and a second group, and the group count values comprise a first group count value and a second group count value, wherein the step of determining the selected group comprises:

selecting the first group to be the selected group through the group selecting unit when a difference between the first group count value and the second group count value is greater than a first threshold; and selecting the second group to be the selected group through the group selecting unit when the difference between the first group count value and the second group count value is less than a second threshold.

13. The operating method according to claim 12, wherein the first part bits belonging to the first group comprise first bit data and second bit data, and the first part bits belonging to the second group comprise third bit data and fourth bit data, the step of determining the gear position signal according to the selected group and the count values comprises:

when the selected group is the first group and a difference between a count value related to the first bit data among the count values and a count value related to the second bit data among the count values is greater than a third threshold, selecting a candidate gear position signal corresponding to the first bit data to be the gear position signal through the gear position determination unit;

when the selected group is the first group and the difference between the count value related to the first bit data among the count values and the count value related to the second bit data among the count values is less than a fourth threshold, selecting a candidate gear position signal corresponding to the second bit data to be the gear position signal through the gear position determination unit;

when the selected group is the second group and a difference between a count value related to the third bit data among the count values and a count value related to the fourth bit data among the count values is greater than a fifth threshold, selecting a candidate gear position signal corresponding to the third bit data to be the gear position signal through the gear position determination unit; and when the selected group is the second group and the difference between the count value related to the third bit data among the count values and the count value related to the fourth bit data among the count values is less than a sixth threshold, selecting a candidate gear position signal corresponding to the fourth bit data to be the gear position signal through the gear position determination unit.

14. The operation method according to claim 10, further comprising:

determining whether to adjust a second part bit of each of the original sub-pixel data for obtaining a plurality of processed sub-pixel data according to the gear position signal through a bit adjusting circuit, wherein the processed sub-pixel data are provided to the source driver.

15. The operating method according to claim 14, wherein the first part bits comprise first bit data, second bit data, third bit data and fourth bit data, wherein the step of obtaining the processed sub-pixel data comprises:

when a first candidate gear position signal corresponding to the first bit data is selected to be the gear position signal and the first part bit of current sub-pixel data among the original sub-pixel data is the first bit data, using a second part bit of the current sub-pixel data as the processed sub-pixel data corresponding to the current sub-pixel data through the bit adjusting circuit; and when the first candidate gear position signal corresponding to the first bit data is selected to be the gear position signal and the first part bit of the current sub-pixel data among the original sub-pixel data is the third bit data, increasing or decreasing the second part bit of the current sub-pixel data through the bit adjusting circuit so as to obtain the processed sub-pixel data corresponding to the current sub-pixel data.

16. The operation method according to claim 10, further comprising:

adjusting the original sub-pixel data of a current sub-pixel according to an error value related to at least one neighboring sub-pixel of the current sub-pixel through an error diffusion circuit so as to obtain processed sub-pixel data of the current sub-pixel, wherein the processed sub-pixel data is provided to the source driver.

17. The operating method according to claim 16, wherein the at least one neighboring sub-pixel data comprises a plurality of neighboring sub-pixels, each of the neighboring sub-pixels having a gray level error, the gray level error value being a difference between the original sub-pixel data of the neighboring sub-pixel and new sub-pixel data of the neighboring sub-pixel, the new sub-pixel data being composed of second part bit of the original sub-pixel data of the neighboring sub-pixel and the gear position signal, the error value being a weighted sum of the gray level errors.

18. The operation method according to claim 10, further comprising:

determining whether to adjust a second part bit of each of the original sub-pixel data for obtaining a plurality of temporary data according to the gear position signal through a bit adjusting circuit; and adjusting the temporary data of a current sub-pixel according to an error value related to at least one neighboring sub-pixel of the current sub-pixel through an error diffusion circuit so as to obtain processed sub-pixel data of the current sub-pixel, wherein the processed sub-pixel data is provided to the source driver.

* * * * *